US010759571B2

(12) United States Patent
Plummer et al.

(10) Patent No.: US 10,759,571 B2
(45) Date of Patent: Sep. 1, 2020

(54) CONTAINER FOR PRODUCE STORAGE, PACKING AND TRANSPORT

(71) Applicant: SONOCO DEVELOPMENT, INC., Hartsville, SC (US)

(72) Inventors: George Plummer, Selah, WA (US); Chadrick Paul Fife, Yakima, WA (US); John Perry, Yakima, WA (US)

(73) Assignee: Sonoco Development, Inc., Hartsville, SC (US)

( * ) Notice: Subject to any disclaimer, the term of this patent is extended or adjusted under 35 U.S.C. 154(b) by 343 days.

(21) Appl. No.: 15/868,867

(22) Filed: Jan. 11, 2018

(65) Prior Publication Data

US 2018/0194523 A1 Jul. 12, 2018

Related U.S. Application Data

(60) Provisional application No. 62/445,236, filed on Jan. 11, 2017.

(51) Int. Cl.
*B65D 17/00* (2006.01)
*B65D 17/34* (2006.01)
(Continued)

(52) U.S. Cl.
CPC ..... *B65D 43/0235* (2013.01); *B65D 17/4011* (2018.01); *B65D 43/162* (2013.01);
(Continued)

(58) Field of Classification Search
CPC . B65D 5/54; B65D 5/70; B65D 5/542; B65D 5/543; B65D 5/5425; B65D 5/3621; B65D 43/0235; B65D 43/162; B65D 2251/1033; B65D 17/4011; B65D 75/5833; B65D 75/5855; B65D 2101/0023;
(Continued)

(56) References Cited

U.S. PATENT DOCUMENTS 2,619,226 A * 11/1952 Adams ..... B65D 83/0805 221/63
2,953,293 A * 9/1960 Anderson ..... B65D 5/725 229/207

(Continued)

*Primary Examiner* — Gideon R Weinerth
(74) *Attorney, Agent, or Firm* — Miller, Matthias & Hull LLP

(57) ABSTRACT

A tamper evident food container is provided. The container comprises a base hingedly connected to a lid. The lid includes an outer raised portion having an integrally connected inner recessed portion formed therein, wherein the inner recessed portion includes a peelable flap portion partially detachable from the inner recessed portion for lifting the peelable flap upwardly from the inner recessed portion; an upper flange extending perpendicularly outward from a perimeter of the lid and having a connecting member located between extending latching portions extending outwardly from the upper flange and adapted for being received in the two latch receiving openings; and a tab connected to the peelable flap portion on a first end and detachably connected to the connecting member on a second end, where the tab is configured for pushing inward to detach the second end from the connecting member allowing the peelable flap portion to be lifted upwardly.

20 Claims, 13 Drawing Sheets

(51) Int. Cl.

| | |
|---|---|
| ***B65D 17/40*** | (2006.01) |
| ***B65D 43/00*** | (2006.01) |
| ***B65D 85/34*** | (2006.01) |
| ***B65D 43/02*** | (2006.01) |
| ***B65D 17/28*** | (2006.01) |
| ***B65D 43/16*** | (2006.01) |
| ***B65D 75/58*** | (2006.01) |
| *B65D 5/54* | (2006.01) |

(52) U.S. Cl.
CPC ..... *B65D 75/5833* (2013.01); *B65D 5/54* (2013.01); *B65D 5/542* (2013.01); *B65D 5/5425* (2013.01); *B65D 75/5855* (2013.01); *B65D 2101/0023* (2013.01); *B65D 2517/0046* (2013.01); *B65D 2543/00101* (2013.01); *B65D 2543/00194* (2013.01); *B65D 2543/00296* (2013.01); *B65D 2543/00351* (2013.01); *B65D 2543/00481* (2013.01); *B65D 2543/00842* (2013.01)

(58) Field of Classification Search
CPC .. B65D 2517/0046; B65D 2543/00101; B65D 2543/00194; B65D 2543/00296; B65D 2543/00351; B65D 2543/00481; B65D 2543/00842; B65D 2543/00833; B65D 2543/00861; B65D 2543/0051
USPC ..... 220/359.2, 270, 266, 810, 254.1, 254.2, 220/254.3, 4.23, 839, 260, 268; 229/232, 229/229, 237, 208; 215/232
See application file for complete search history.

(56) References Cited

U.S. PATENT DOCUMENTS 3,307,746 A * 3/1967 Edwards ..... B65D 17/28 222/143
3,360,119 A * 12/1967 Mullinix ..... B65D 21/0219 206/773
3,779,417 A * 12/1973 Klein ..... B65D 17/401 220/268
4,531,668 A * 7/1985 Forbes, Jr. ..... B65D 77/206 229/123.2
5,894,950 A * 4/1999 Kick ..... B65D 17/166 220/268
2005/0000966 A1* 1/2005 Nordland ..... B29C 51/32 220/367.1
2005/0109827 A1* 5/2005 Martin ..... B65D 5/5435 229/232
2005/0150891 A1* 7/2005 Schalk ..... B65D 77/2056 220/266
2006/0201946 A1* 9/2006 Witt ..... B29C 66/12441 220/276
2007/0012710 A1* 1/2007 Vovan ..... B65D 43/162 220/793
2007/0023435 A1* 2/2007 Sierra-Gomez ..... B65D 77/206 220/359.2
2007/0023436 A1* 2/2007 Sierra-Gomez .... B65D 75/5855 220/359.2
2011/0174819 A1* 7/2011 Murphy ..... B65D 43/0254 220/270
2011/0240644 A1* 10/2011 Kimmell ..... B29C 51/02 220/266
2014/0014658 A1* 1/2014 Vargas ..... B65D 43/0235 220/266
2014/0138376 A1* 5/2014 Cheung ..... H05B 6/6408 219/735
2014/0190969 A1* 7/2014 Huang ..... B65D 77/2032 220/268
2014/0190970 A1* 7/2014 Huang ..... B65D 77/2032 220/268
2015/0083725 A1* 3/2015 Sinha ..... B65D 43/0272 220/265
2015/0307239 A1* 10/2015 Chen ..... B65D 43/162 220/270
2015/0321799 A1* 11/2015 Lam ..... B65D 85/70 220/315
2016/0023815 A1* 1/2016 Siskindovich ..... B65D 43/162 220/270
2016/0096667 A1* 4/2016 Huffer ..... B65D 25/54 220/257.2
2018/0057240 A1* 3/2018 Malcolm ..... B65D 43/02
2018/0194523 A1* 7/2018 Plummer ..... B65D 75/5833

* cited by examiner

FIG. 7
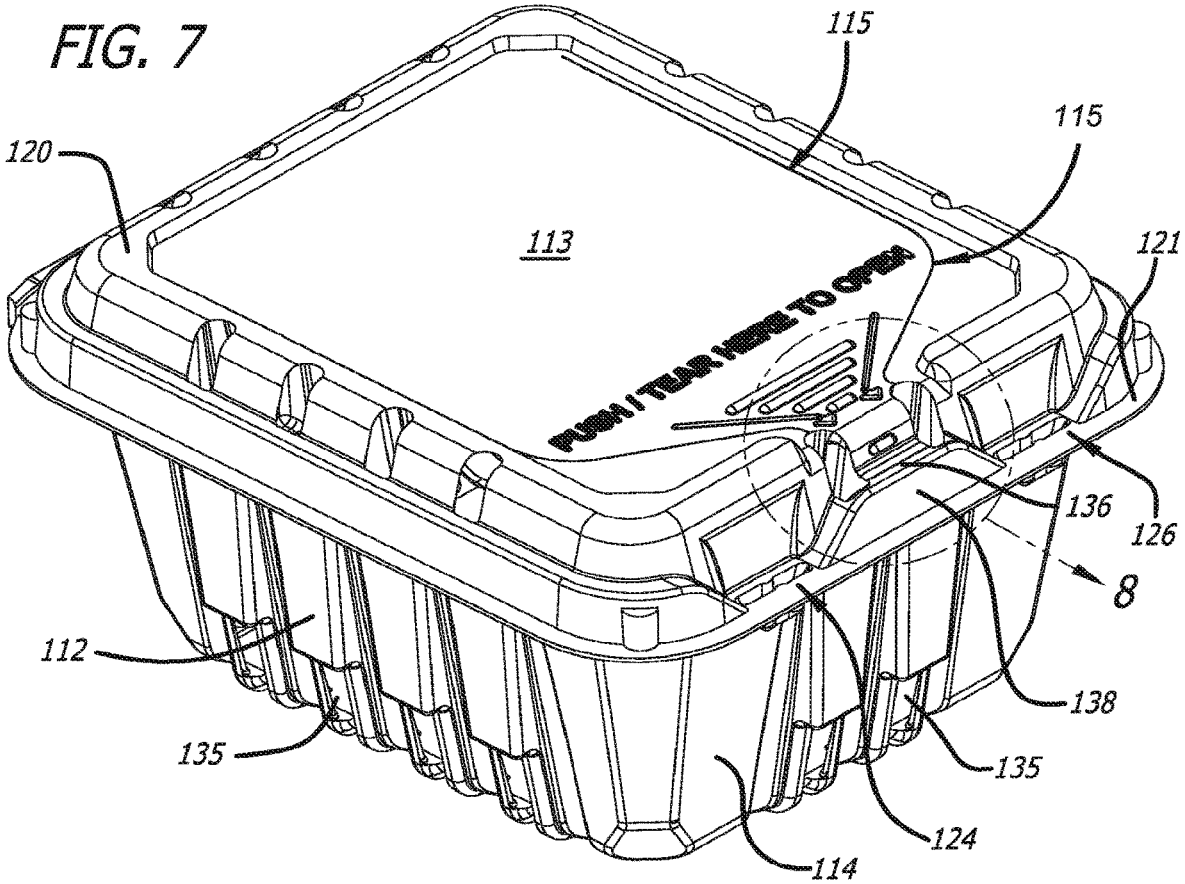
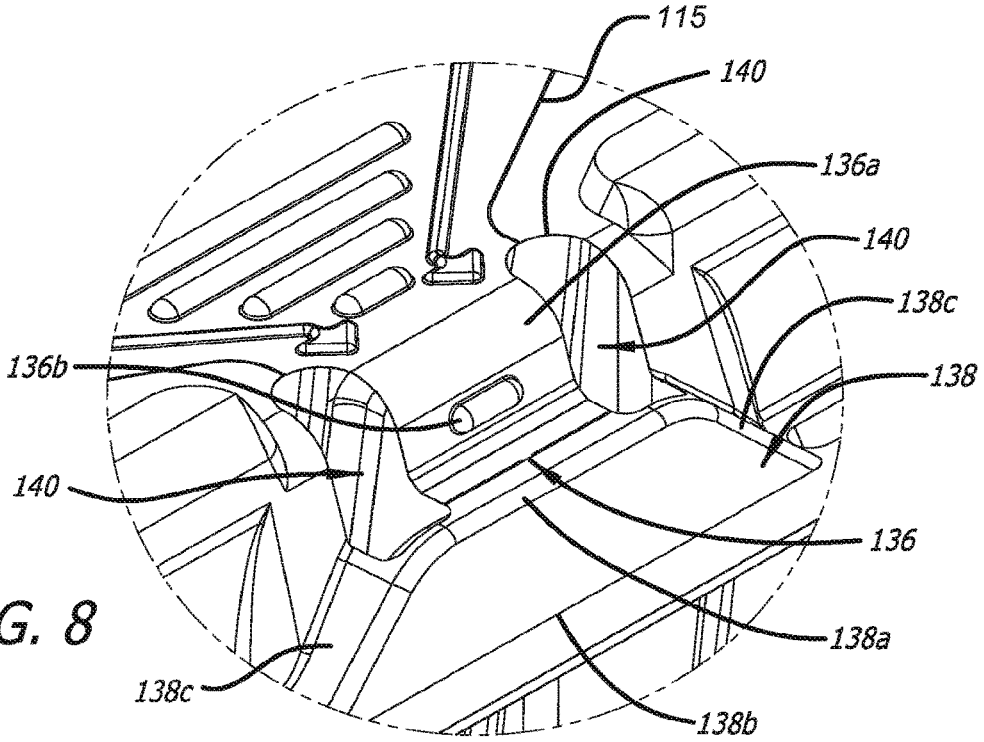
FIG. 8

FIG. 9
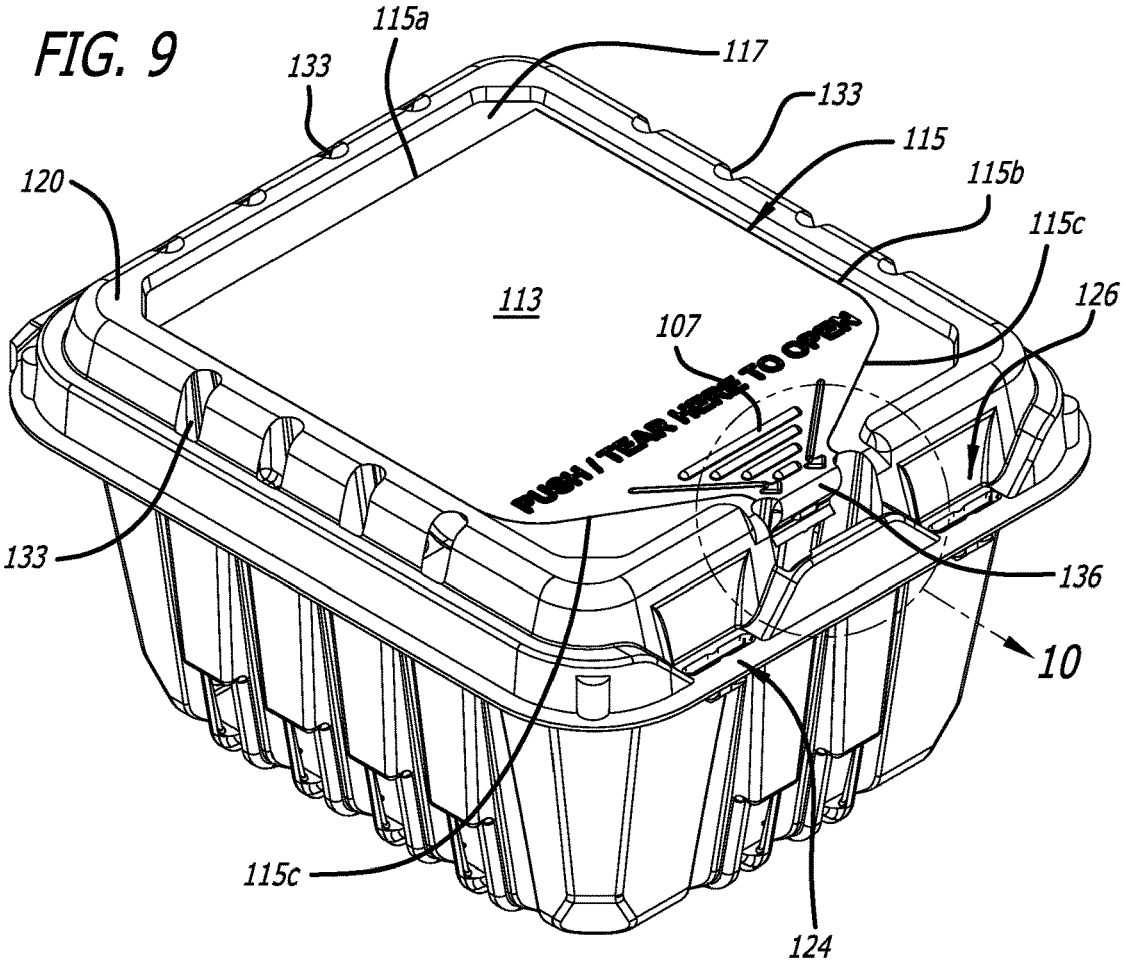
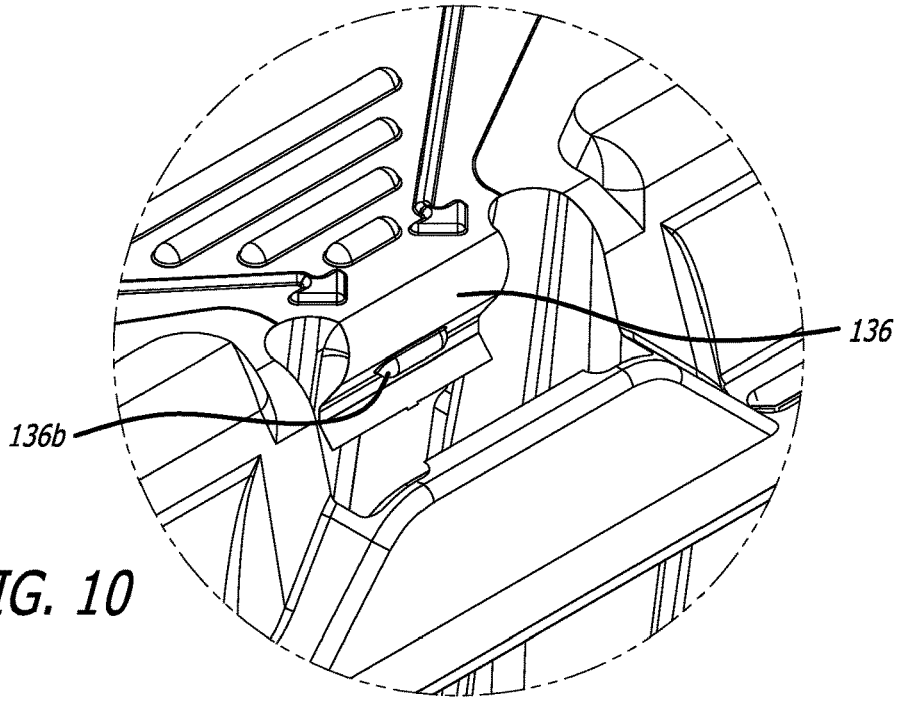
FIG. 10

CONTAINER FOR PRODUCE STORAGE, PACKING AND TRANSPORT

CLAIM OF PRIORITY UNDER 35 U.S.C. § 119

The present Utility Application for Patent claims priority to U.S. Provisional Application No. 62/445,236 entitled "Container for Produce Storage, Packing & Transport" filed Jan. 11, 2017, and hereby expressly incorporated by reference herein.

FIELD

The present invention relates to the field of containers, in particular to tamper evident containers which include a peelable flap portion located within the lid of the container that is secured by a tab which can be broken allowing a consumer to peel back a portion of the lid for access and then reseal the container by placing the flap portion back into its original position.

BACKGROUND

It is common to use clear plastic hinged containers to transport and package fresh and chilled foods, including but not limited to fruit, vegetables and bakery items, for selling to consumers. The containers come in various shapes and sizes and allow the food to be transported with less damage, such as bruising, and provide convenient packaging for consumers who are purchasing the food.

One common type of container includes a base connected to a lid via a hinge. Typically the food items are placed in the base and the lid is hingedly folded over onto the base to secure the food items within the container. Due to safety concerns, the food industry is demanding food containers that incorporate tamper evident and tamper resistant features.

Tamper evident features typically include features which, when the container is tampered with or has been opened, enable the consumer to easily visually recognize the container has been tampered with and not purchase or consume foods from that container. Containers containing tamper evident and resistant features are also important for deterring theft and preventing the loss of food or other product and income for the seller. These features also inspire confidence in consumers in the integrity of the contents located within the container, and confidence in the ability of the seller and/or manufacturer to provide and maintain food products.

Currently, many sellers and/or manufacturers utilize shrink bands with vertical or horizontal perforations to seal the lid to the base of food containers showing that the contents have not been tampered with. These shrink bands can be difficult to remove and when removed create an extra piece of waste that needs to be thrown out. Furthermore, as not all containers utilize shrink bands it is not necessarily possible for a consumer to determine if the container has been tampered with.

Consequently, a container that not only provides visible evidence of the integrity of the contents of the container but also allows the container to be easily opened and reclosed maintaining the freshness of the remaining contents is needed.

SUMMARY

The following presents a simplified summary of one or more implementations in order to provide a basic understanding of some implementations. This summary is not an extensive overview of all contemplated implementations, and is intended to neither identify key or critical elements of all implementations nor delineate the scope of any or all implementations. Its sole purpose is to present some concepts of one or more implementations in a simplified form as a prelude to the more detailed description that is presented later.

According to one aspect, a tamper evident container is provided. The tamper evident container comprises a base having a bottom, a pair of sidewalls, and a pair of end walls, the bottom, the pair of sidewalls and the pair of end walls being integrally connected wherein an edge of the pair of sidewalls and the at least one end wall extend outwardly to form a lower flange, the lower flange comprising at least two latch receiving openings; and a lid hingedly connected to the base. The lid comprises an outer raised portion having an integrally connected inner recessed portion formed therein, wherein the inner recessed portion includes a peelable flap portion partially detachable from the inner recessed portion for lifting the peelable flap upwardly from the inner recessed portion; an upper flange extending perpendicularly outward from a perimeter of the lid and having a connecting member located between at least at least two extending latching portions extending outwardly from the upper flange, the at least two extending latching portions adapted for being received in the at least two latch receiving openings; and a tab connected to the peelable flap portion on a first end and detachably connected to the connecting member on a second end, where the tab is configured for pushing inward detaching the second end from the connecting member allowing the peelable flap portion to be lifted upwardly away from the inner recessed portion.

According to one feature, the inner recessed portion comprises a back edge; a pair of side edges having proximal ends and distal ends, the distal ends integrally connected to the back edge; and a pair of front edges integrally connected to the proximal ends of the pair of side edges and extending inwardly to the tab.

According to another feature, wherein the peelable flap portion is integrally connected to the back edge of the inner recessed portion and detachably connected to the pair of side edges and the pair of front edges of the peelable flap portion.

According to yet another feature, wherein the peelable flap portion is detachably connected to the pair of side edges and the pair of front edges of the inner recessed portion by perforations.

According to yet another feature, wherein the tab is located between a pair of tab vents.

According to yet another feature, wherein the tab is comprised of a flexible elongated material.

According to yet another feature, wherein the tab includes a horizontally elongated protrusion.

According to yet another feature, wherein the connecting member comprises; an upper surface edge; a lower connected surface edge opposing the upper surface edge; a pair of side surface edges integrally connecting the upper surface edge and the lower surface edge.

According to yet another feature, wherein a length of the upper surface is shorter than a length of the lower surface.

According to yet another feature, wherein the peelable flap portion fits is received within the inner recessed portion once peeled back allowing reclosure.

According to yet another feature, wherein the peelable flap portion includes one or more protrusions before the tab.

According to yet another feature, wherein each of the one or more protrusions is of varying length.

According to yet another feature, wherein the base includes a plurality of base vents for allowing air to circulate within the container.

According to yet another feature, wherein the base further comprises a base back upper portion of having one or more back upper portion openings; wherein the lid further comprises a lid back portion having lid extending latching portions; and wherein the lid extending latching portions are received within the one or more back upper portion openings when the lid is secured to the base.

BRIEF DESCRIPTION OF THE DRAWINGS

The features, nature, and advantages of the present aspects may become more apparent from the detailed description set forth below when taken in conjunction with the drawings in which like reference characters identify correspondingly throughout.

FIG. 7 illustrates a top left perspective view of the container of FIG. 1 in a closed configuration with an unbroken tab.

FIG. 8 illustrates an enlarged fragmentary view of a tab on the lid of the container of FIG. 7.

FIG. 9 illustrates a top left perspective view of the container of FIG. 1 in a closed configuration with a broken tab.

FIG. 10 illustrates an enlarged fragmentary view of broken tab on the lid of the container of FIG. 8.

DETAILED DESCRIPTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

In the following description, certain terminology is used to describe certain features of one or more embodiments of the invention. The term "container" refers to any type of device for holding objects, including a receptacle, a bin, a box, a carton, a case, and a crate. The term "food" refers to any type of edible substance including all types of fruits, vegetables and bakery items.

According to embodiments of the present disclosure, the containers 100 and 200 may be made of polyethylene terephthalate (PET), polystyrenes, polypropylenes, or any other suitable material known in the art.

Overview

One aspect of the present disclosure provides a tamper evident container for packaging food for transporting and selling to consumers. The container includes a base hingedly connected to a lid. The lid includes an outer raised portion having an integrally connected inner recessed portion formed therein, wherein the inner recessed portion includes a peelable flap portion partially detachable from the inner recessed portion for lifting the peelable flap upwardly from the inner recessed portion; an upper flange extending perpendicularly outward from a perimeter of the lid and having a connecting member located between extending latching portions extending outwardly from the upper flange and adapted for being received in the two latch receiving openings; and a tab connected to the peelable flap portion on a first end and detachably connected to the connecting member on a second end, where the tab is configured for pushing inward to detach the second end from the connecting member allowing the peelable flap portion to be lifted upwardly.

Locking Mechanisms—Die Cut Clip Locking Feature

Figure 1:
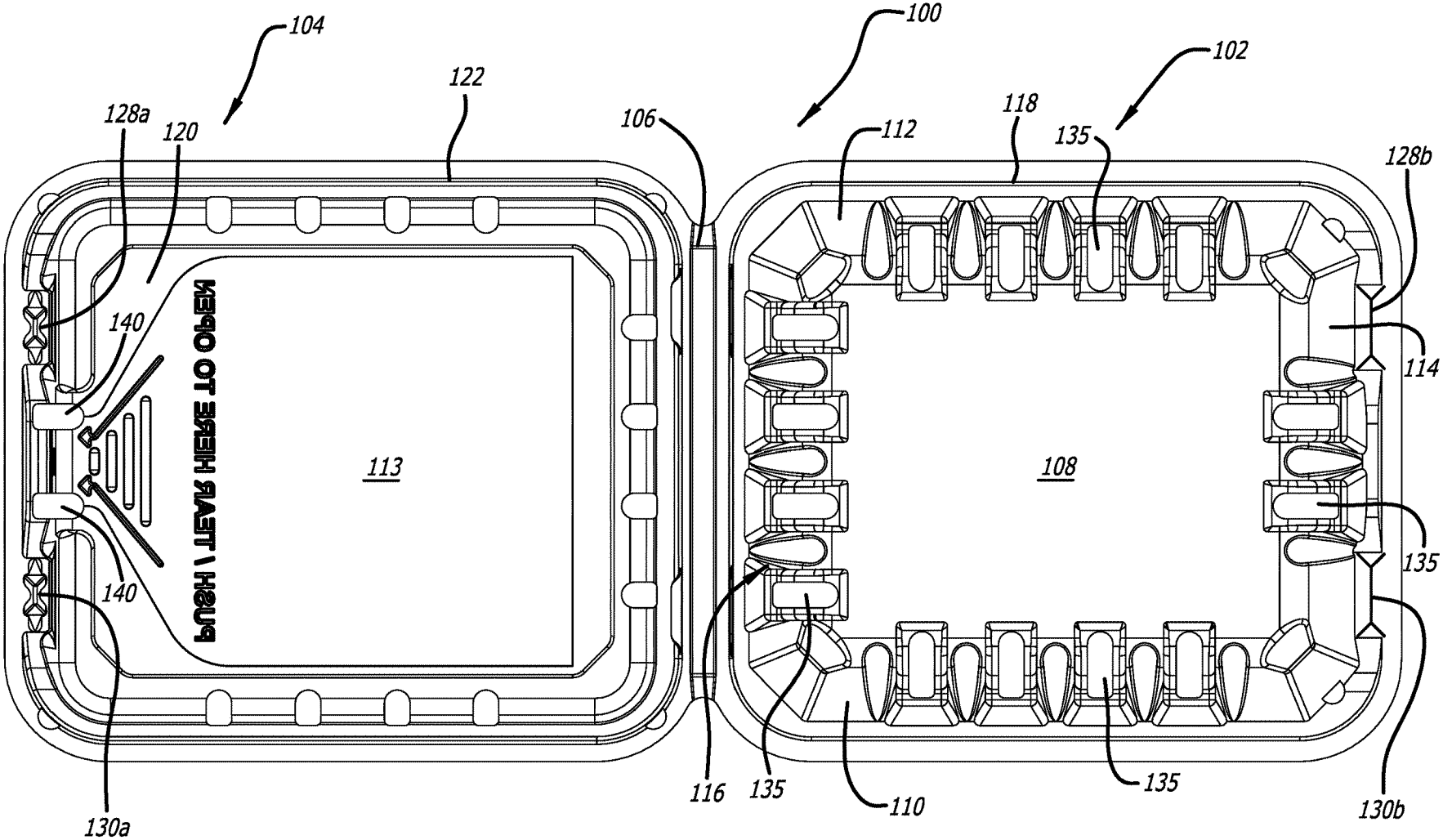
FIG. 1 illustrates a top plan view of a container in an open configuration according to one embodiment of the present disclosure.
Figure 3:
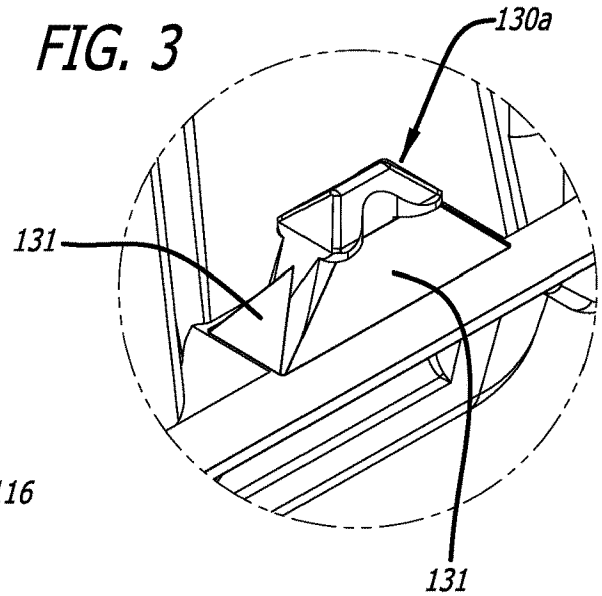
FIG. 3 illustrates an enlarged fragmentary view of a closed locking mechanism of the container of FIG. 2.
Figure 2:
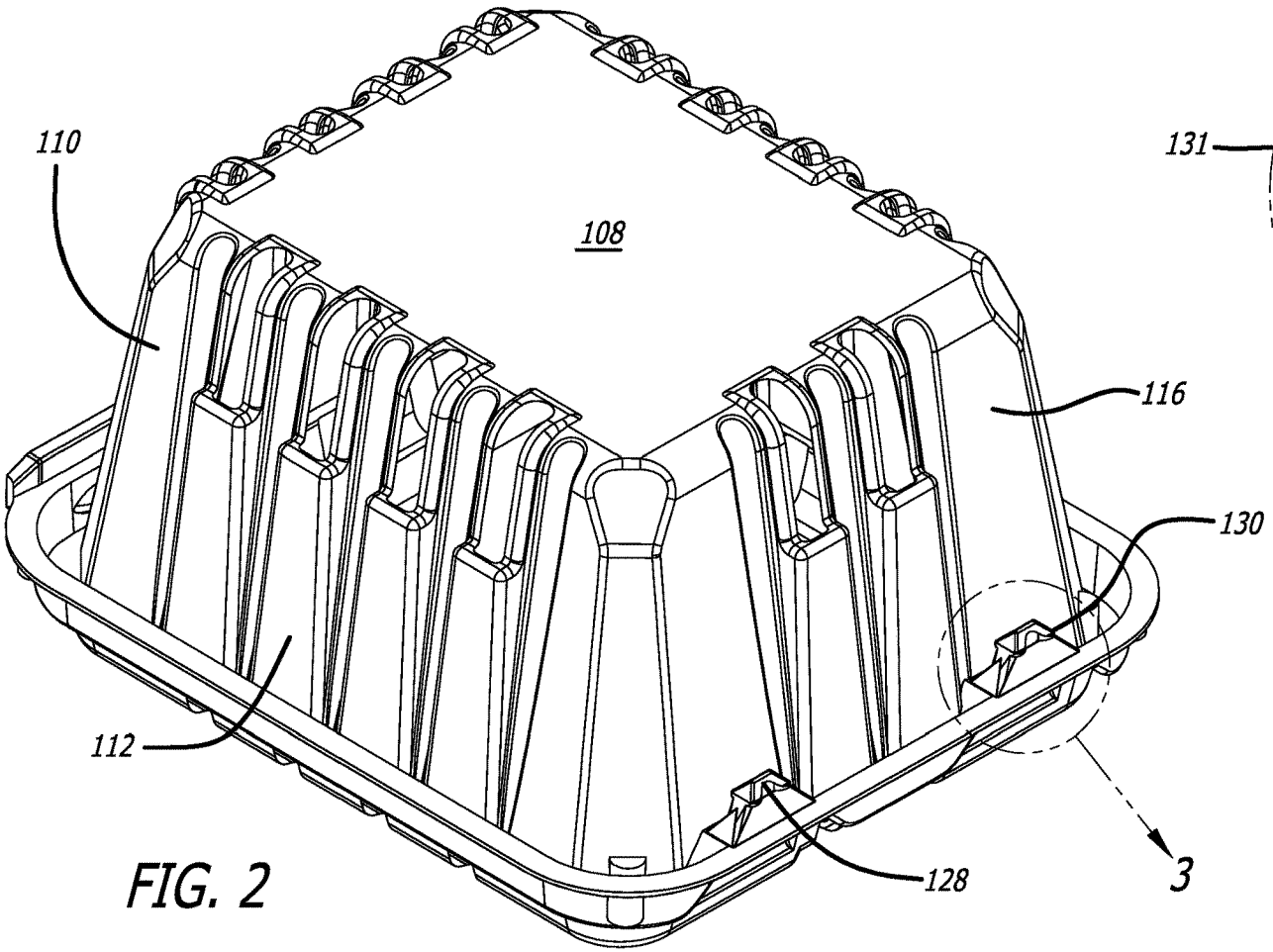
FIG. 2 illustrates a bottom left perspective view of the container of FIG. 1 in a closed configuration.
Figure 4:
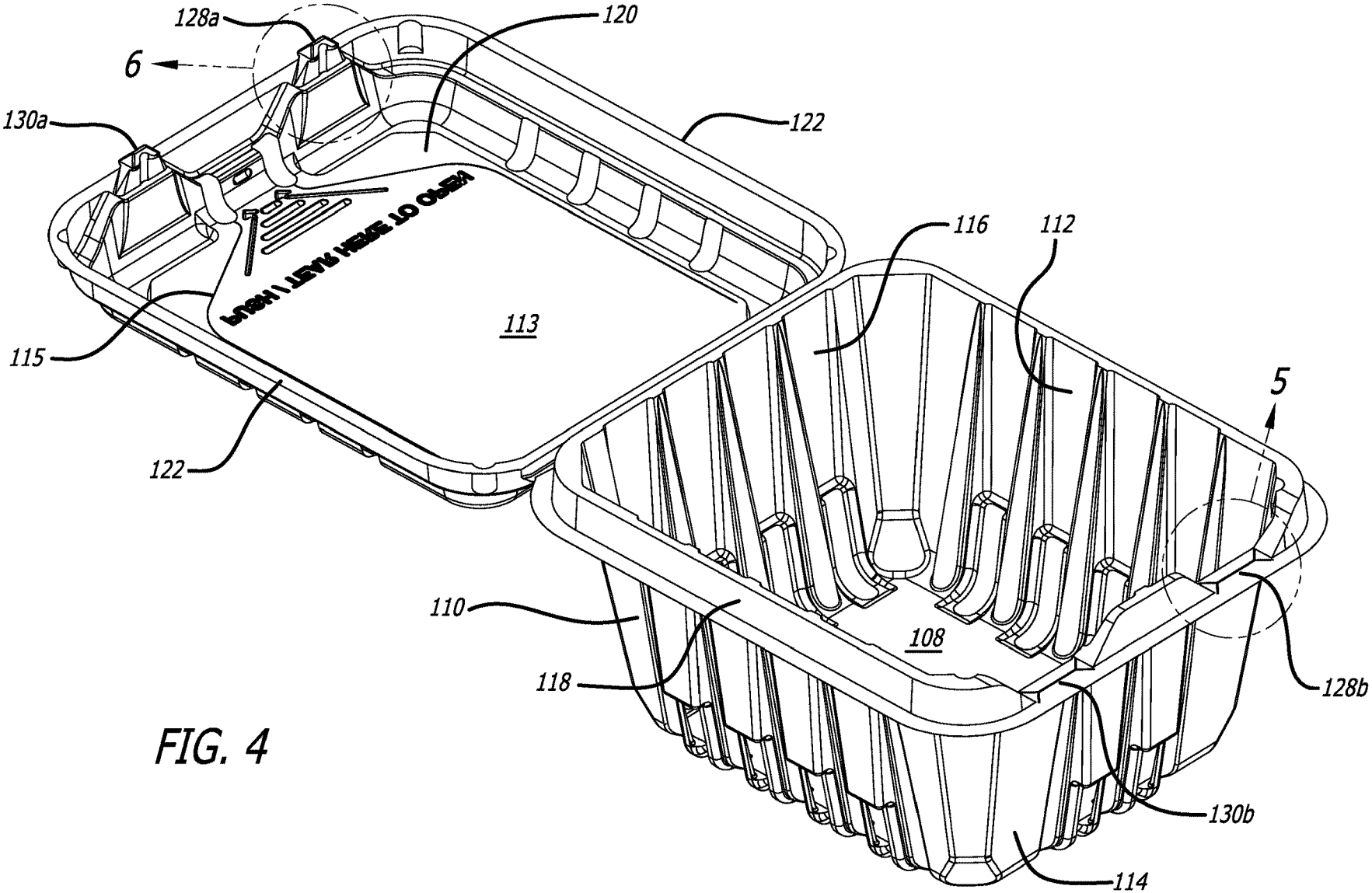
FIG. 4 illustrates a top left perspective view of the container of FIG. 1 in an open configuration.
Figure 5:
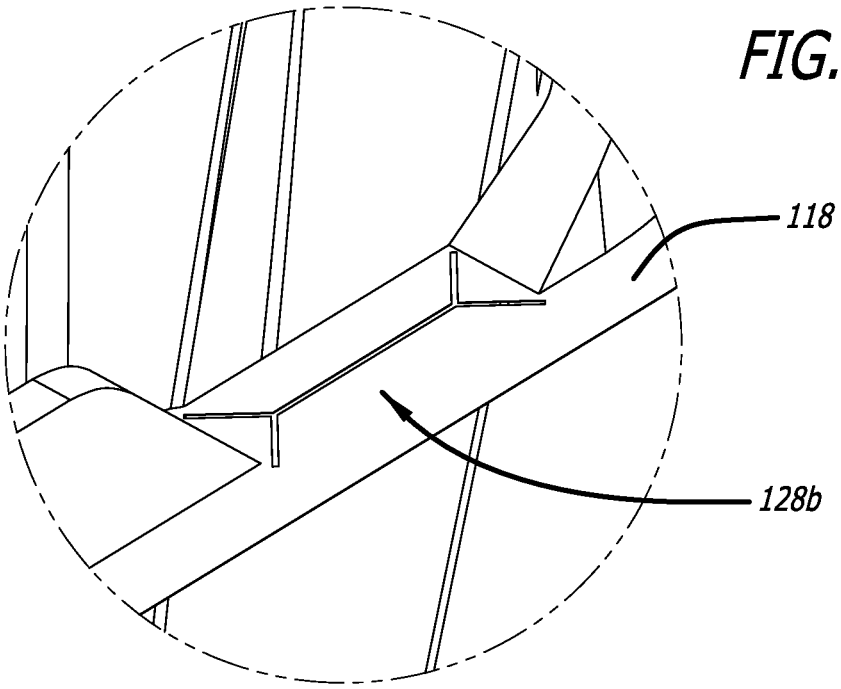
FIG. 5 illustrates an enlarged fragmentary view of a die cut clip locking feature of a locking mechanism of the container of FIG. 4.
Figure 6:
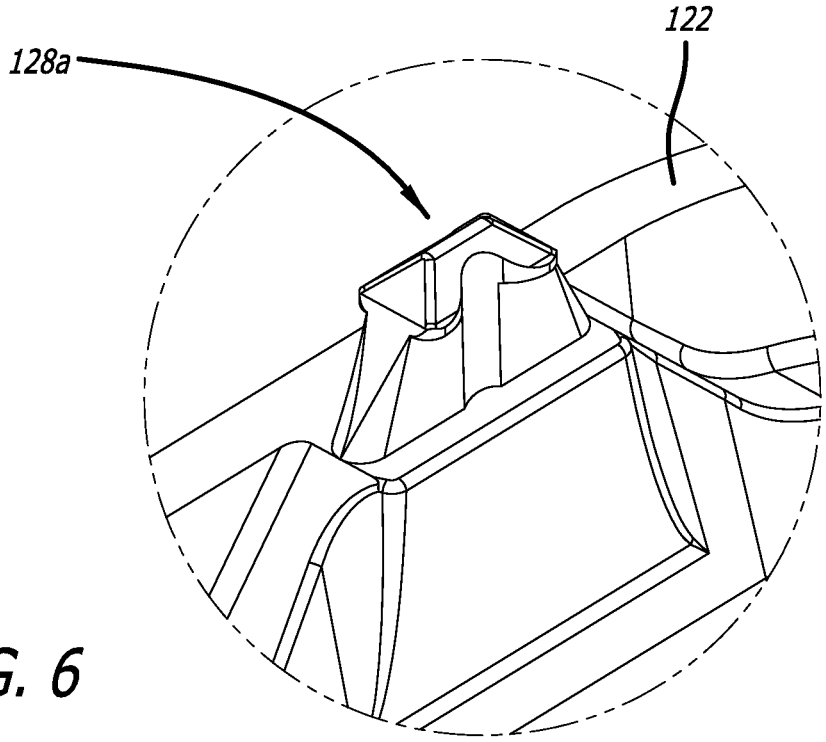
FIG. 6 illustrates an enlarged fragmentary view of an extending latching portion of a locking mechanism of the container of FIG. 4.
Figure 11:
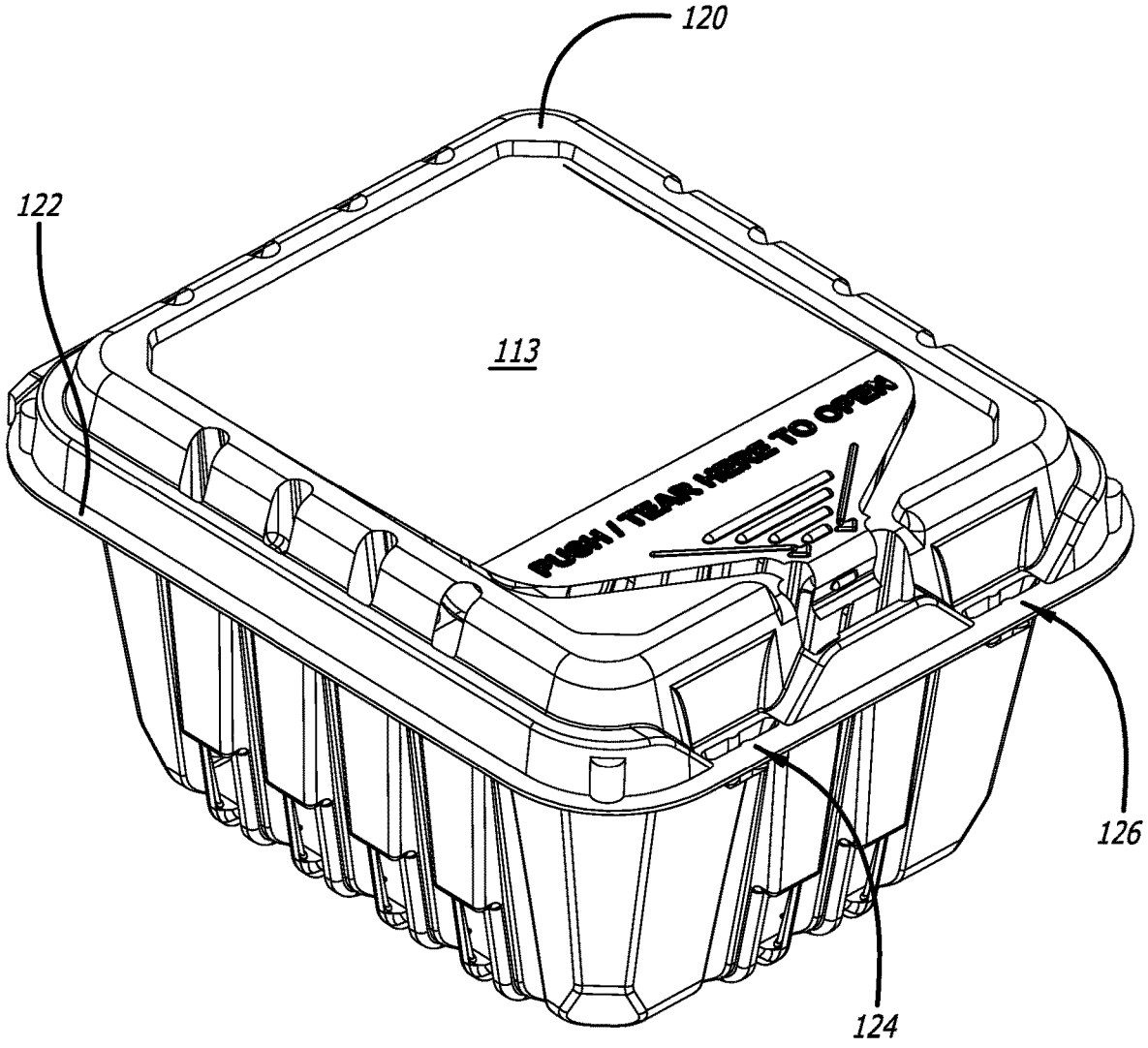
FIG. 11 illustrates a top left perspective view of the container of FIG. 9 showing a peelable flap portion of the lid in a partially peeled back position.
Figure 12:
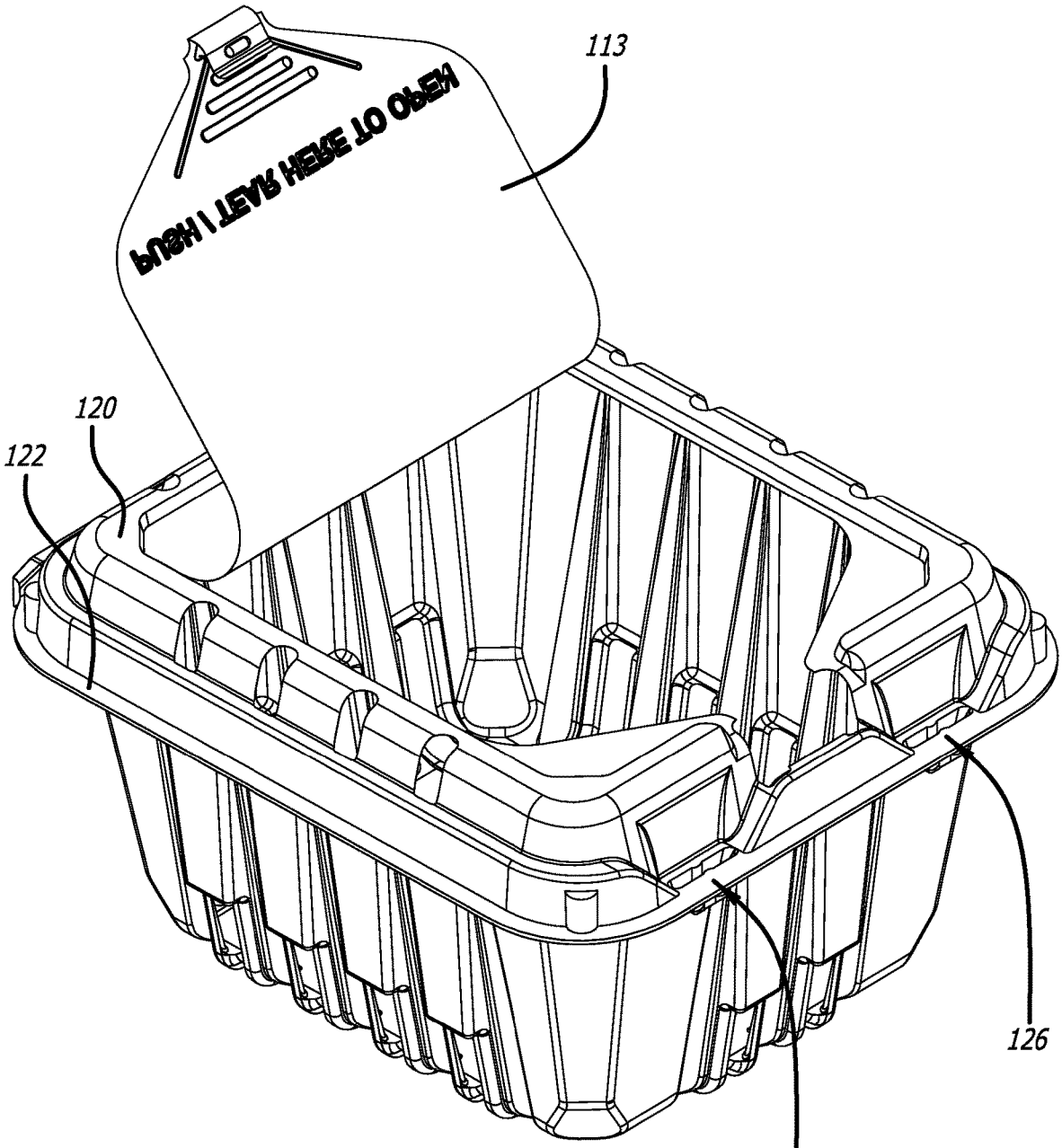
FIG. 12 illustrates a top left perspective view of the container of FIG. 11 showing the peelable flap portion of the lid in an open position.

FIG. 1 illustrates a top plan view of a container in an open configuration according to one embodiment of the present disclosure. FIG. 2 illustrates a bottom left perspective view of the container of FIG. 1 in a closed configuration. FIG. 3 illustrates an enlarged fragmentary view of a closed locking mechanism of the container in FIG. 2. FIG. 4 illustrates a top left perspective view of the container of FIG. 1 in an open configuration. FIG. 5 illustrates an enlarged fragmentary view of a die cut clip locking feature of a locking mechanism of the container of FIG. 4. FIG. 6 illustrates an enlarged fragmentary view of an extending latching portion of a locking mechanism of the container of FIG. 4. FIG. 7 illustrates a top left perspective view of the container of FIG. 1 in a closed configuration with an unbroken tab. FIG. 8 illustrates an enlarged fragmentary view of a tab on the lid of the container of FIG. 7. FIG. 9 illustrates a top left perspective view of the container of FIG. 1 in a closed configuration with a broken tab. FIG. 10 illustrates an enlarged fragmentary view of broken tab on the lid of the container of FIG. 8. FIG. 11 illustrates a top left perspective view of the container of FIG. 9 showing a peelable flap portion of the lid in a partially peeled back position. FIG. 12 illustrates a top left perspective view of the container of FIG. 11 showing the peelable flap portion of the lid in an open position. The following discussion refers interchangeably to FIGS. 1-12.

As shown, a container 100 includes a base 102 connected to a lid 104 via a hinge 106. The base 102 includes a bottom 108 and two opposing sidewalls 110 and 112 integrally connected to two opposing end walls 114 and 116. The sidewalls, 110 and 112, and end walls, 114 and 116, extend continuously upwardly from the bottom 108 to form the base 102. The uppermost edges of the sidewalls 110, 112 and the end walls 114, 116 define a perimeter of the base 102 by which a lower flange 118 is integrally connected thereto. The lower flange 118 generally projects in an outwardly or an approximately perpendicular fashion relative to the perimeter.

The lid 104, integrally connected to an upper flange 122, may include an outer raised portion 120, having an integrally connected inner recessed portion 117. The upper flange 122 generally projects in an outwardly or an approximately perpendicular fashion relative to the perimeter of the lid 104. A front portion 121 (See FIG. 7) of the upper flange 122 (opposite the hinge 106) may include a connecting member 138 located between a pair of extending latching portions 128*a* and 130*a* (See FIG. 4) of locking mechanisms 128 and 130 (described below in further detail) and extending upwardly from the upper flange 122. The connecting member 138 may have an upper connecting surface edge 138*a* and an opposing lower connecting surface edge 138*b* integrally connected by a pair of side connecting surface edges 138*c*. According to one example, the upper connecting surface edge 138*a* may have a length shorter than the length of the lower connecting surface edge 138*b* such that the pair of side connecting surface edges 138*c* extend downwardly at an angle from the upper connecting surface edge 138*a* to the lower connecting surface edge 138*b*.

A peelable flap portion 113 formed within the inner recessed portion 117 (See FIG. 9), the boundaries of which are comprised of a back edge 115*a*, a pair of side edges 115*b* connected to the back edge 115*a* and a pair of front edges 115*c* connected to proximal ends of the pair of side edges 115*b* and extending inwardly to a tab 136. Although the pair of front edges 115*c* are shown angled inwardly, this is by way of example only and the pair of front edges 115*c* may extend perpendicularly from the pair of side edges 115*b* to the tab 136 or at any other angle. The back edge 115*a* of the peelable flap portion 113 may be integrally connected to the inner recessed portion 117 while the pair of side edges 115*b* and the pair of front edges 115*c* may be separable or detachable from the inner recessed portion 117 by perforations 115 or scoring. The peelable flap portion 113 may be peeled upwardly allowing access to the interior of the container 100. The peelable flap portion 113 is flexible and remains secured to the lid 104 allowing the peelable flap portion 113 to be lowered back into the original position closing or resealing the container 100. The peelable flap portion 113 may further include one or more protrusions 107 configured for allowing the consumer to easily grip the peelable flap portion 113 and pull back.

The lid 104 may further comprise a tab 136 connected to, or formed into, the peelable flap portion 113 between the pair of front edges 115*c* at a distal end of the tab 136 and detachably connected to the upper connecting surface edge 138*a* of the connecting member 138. As can be seen in FIG. 8, the tab 136 may comprise a flexible elongated component or material 136*a* having an elongated protrusion 136*b* extending horizontally and parallel to the upper flange 122. Tab openings or vents 140 may be located on the sides of the tab 136. To obtain access to the contents of the container 100, a user may push inwardly on the tab 136 breaking or detaching the flexible elongated component or material 136*a* of the tab 136 from the connecting member 138 (See FIG. 10). Once the flexible elongated component or material 136*a* of the tab 136 is broken from the connecting member 138, the user may then pull upwardly on the peelable flap portion 113 breaking the perforations 115 connecting the peelable flap portion 113 from the inner recessed portion 117 providing access to the interior of the container 100. FIGS. 9 and 10 illustrate the flexible elongated component or material 136*a* of the tab 136 separated or detached from the connecting member 138. FIG. 11 illustrates the peelable flap portion 113 partially pulled upward with the perforations on the pair of front edges 115*c* broken. FIG. 12 illustrates the peelable flap portion 113 pulled all the way back breaking all the perforations allowing access to the interior of the container 100.

According to one example, the outer raised portion 120 may have a substantially rectangular or square shape. However, in alternative embodiments, the outer raised portion 120 may be in the form of a different shape including but not limited to an oval, triangle, square, circular or other polygons.

According to one example, top openings or vents 133 may be spaced apart along the sides and back end of the outer raised portion 120 to allow air to circulate through the container 100.

According to one example, base openings or vents 135 may be spaced apart along the sides, front end and back end of base 102 of the container 100 to allow air to circulate through the container 100.

The container 100 may also include a pair of locking mechanisms 128 and 130 to secure the lid 104 to the base 102 and prevent consumers from prematurely or easily opening the container 100 prior to sale, as well as preventing the lid 104 from separating from the base 102 during transportation and spilling and/or damaging its contents. The pair of locking mechanisms 128 and 130 may include extending latching portions 128*a* and 130*a* (See FIG. 6) which may be received by, or into, die cut clip locking features 128*b* and 130*b* (See FIG. 5). The die cut locking feature may be in the form of an elongated horizontal die cut having two outwardly extending die cuts at each end of the elongated horizontal die cut forming a "V" shape on each end. This shape is by way of example only and other configurations of die cuts may be utilized. The extending latching portions 128*a* and 130*a* may be received into or pushed through die cut clip locking features 128*b* and 130*b* securing the lid 104 to the base 102.

When engaged, the extending latching portions 128*a* and 130*a* extend through the die cut clip locking features 128*b* and 130*b* creating a plurality of flap portions 131 extending downwardly from the flanges preventing the locking mechanisms 128, 130 from being opened. (See FIG. 3) As shown, the extending latching portions may have a spade configuration. Although two locking mechanisms 128 and 130 are shown, the container 100 may have only one locking mechanism or may have more than two locking mechanisms.

According to one aspect, the outer raised portion 120 may have first and second notches 124 and 126 in the same location as the extending latching portions 128*a* and 130*a* of locking mechanisms 128 and 130, respectively, allowing for a user to place a thumb or other finger to aid in accessing the container.

Locking Mechanisms—Latch Receiving Openings

Figure 13:
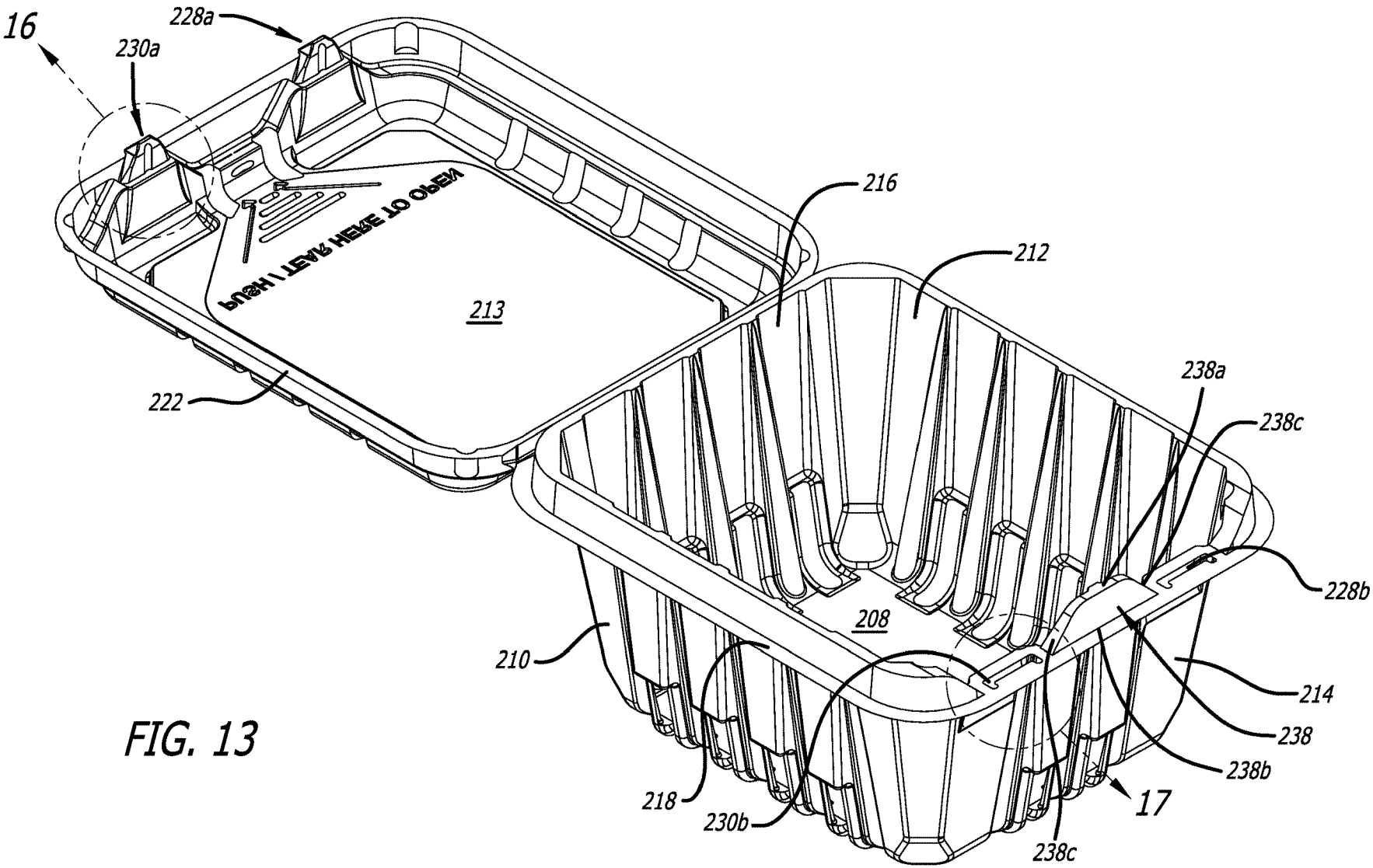
FIG. 13 illustrates a top left perspective view of a container in an open configuration according to another embodiment of the present disclosure.
Figure 14:
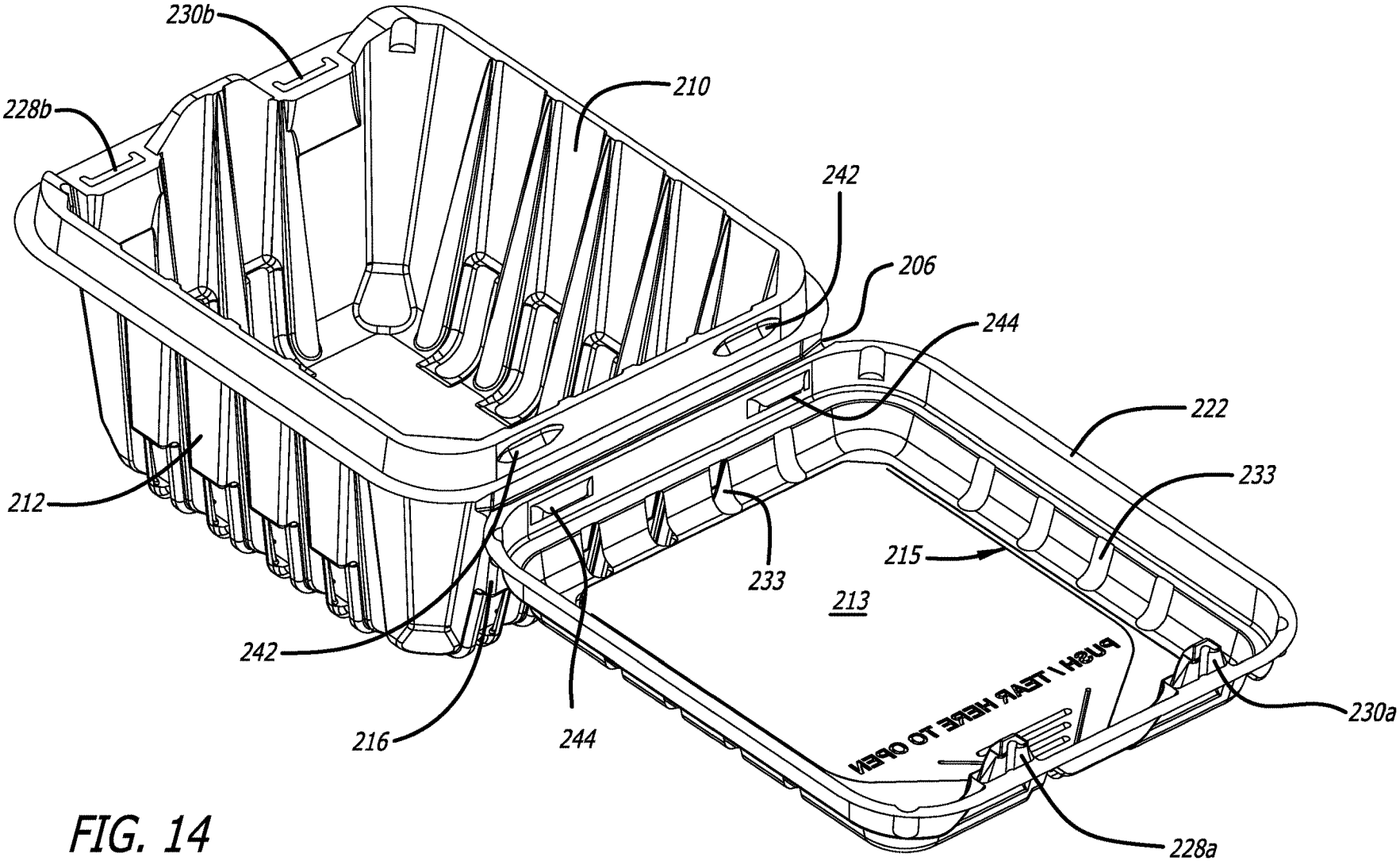
FIG. 14 illustrates a top right perspective view of the container of FIG. 13.
Figure 15:
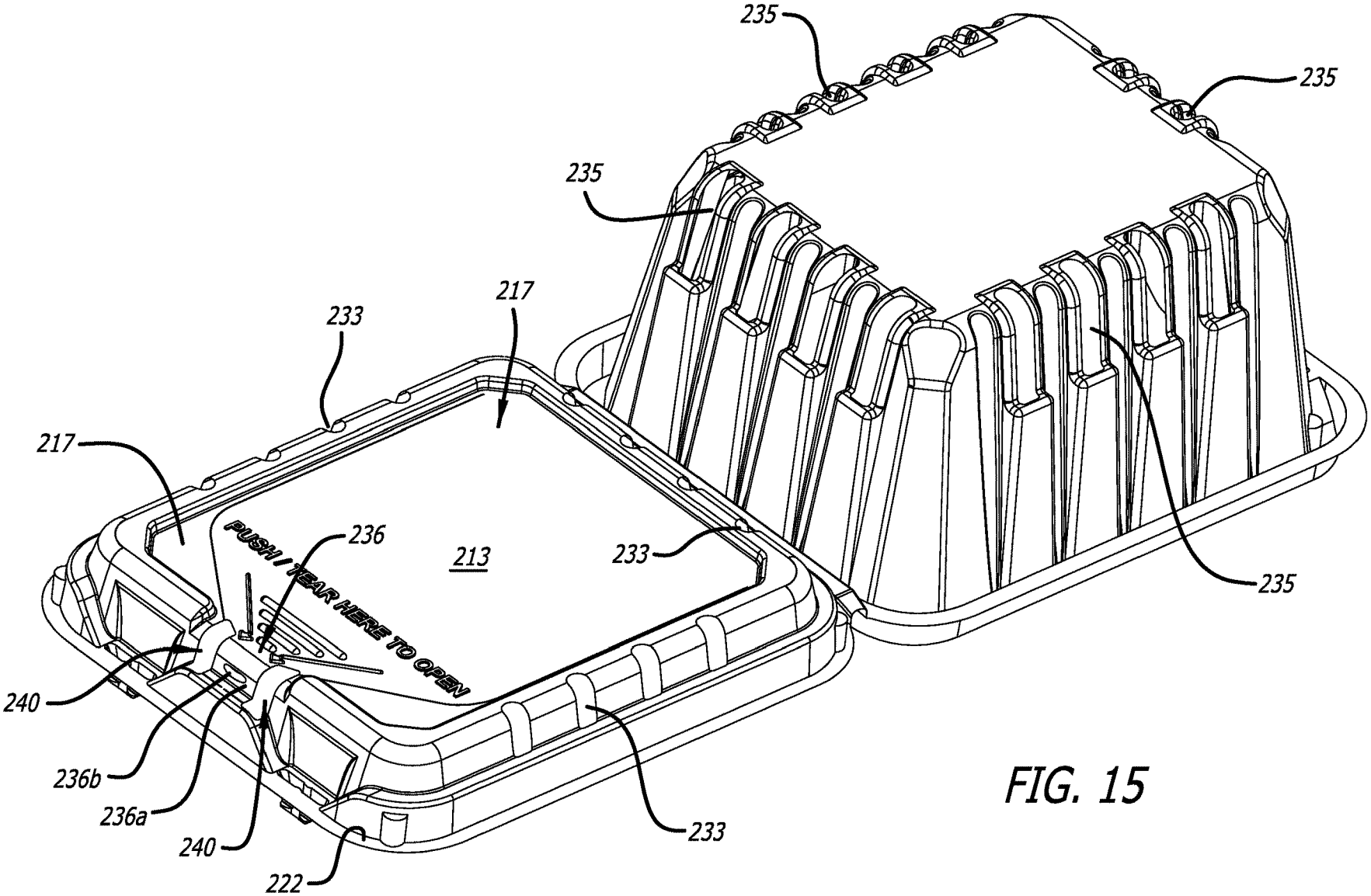
FIG. 15 illustrates a bottom left perspective view of the container of FIG. 13.
Figure 16:
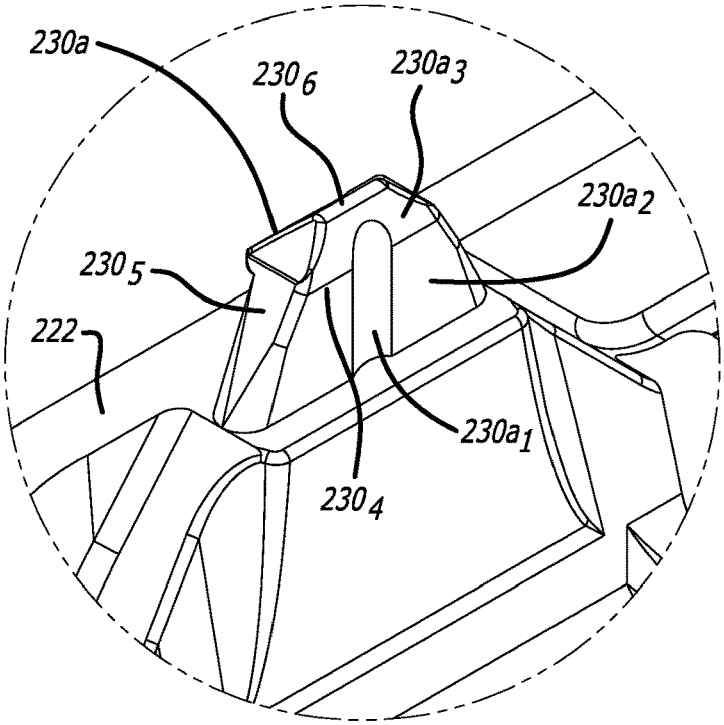
FIG. 16 illustrates an enlarged fragmentary view of an extending latching portion of a locking mechanism of the container of FIG. 13.
Figure 17:
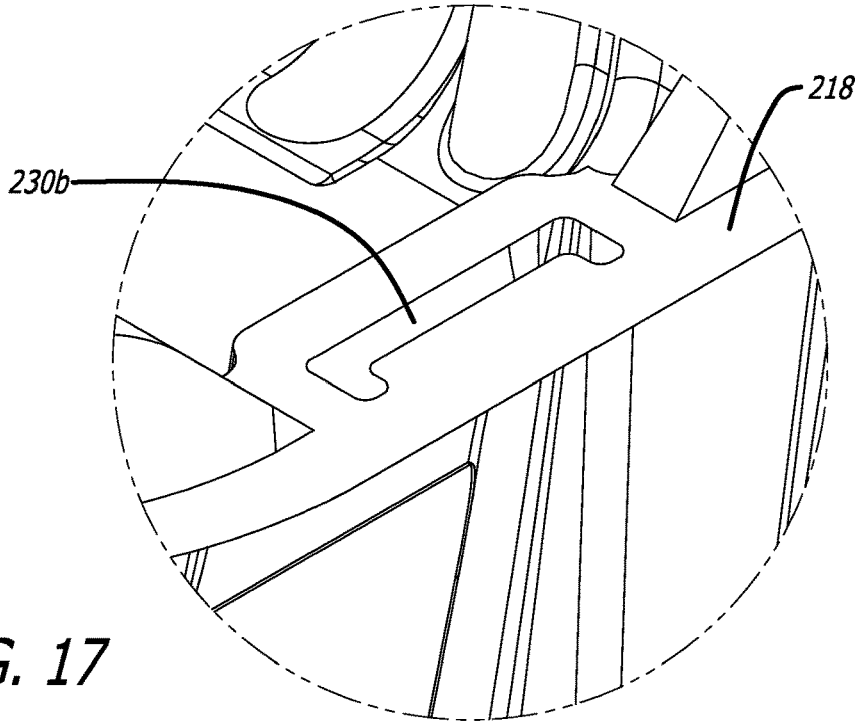
FIG. 17 illustrates an enlarged fragmentary view of a latch receiving opening of a locking mechanism the container of FIG. 13.
Figure 18:
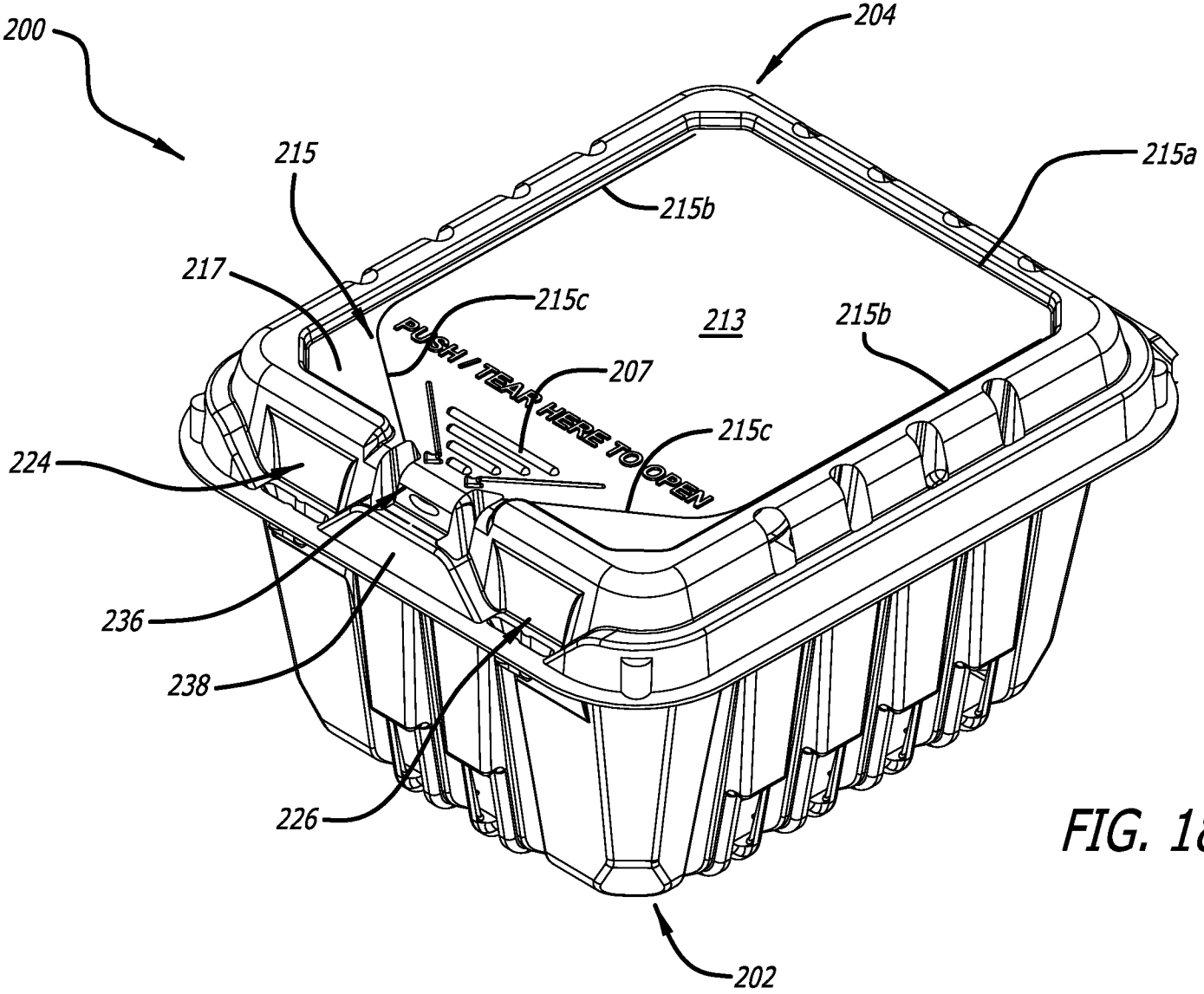
FIG. 18 illustrates a top right perspective view of the container of FIG. 13 in a closed configuration with an unbroken tab.

FIG. 13 illustrates a top left perspective view of a container in an open configuration according to another embodiment of the present disclosure. FIG. 14 illustrates a top right perspective view of the container of FIG. 13. FIG. 15 illustrates a bottom left perspective view of the container of FIG. 13. FIG. 16 illustrates an enlarged fragmentary view of an extending latching portion of a locking mechanism of the container of FIG. 13. FIG. 17 illustrates an enlarged fragmentary view of a latch receiving opening of a locking mechanism the container of FIG. 13. FIG. 18 illustrates a top right perspective view of the container of FIG. 13 in a closed configuration with an unbroken tab. The following discussion refers interchangeably to FIGS. 13-18.

As shown, a container 200 includes a base 202 connected to a lid 204 via a hinge 206. The base 202 includes a bottom 208 and two opposing sidewalls 210 and 212 integrally connected to two opposing end walls 214 and 216. The sidewalls, 210 and 212, and end walls, 214 and 216, extend continuously upwardly from the bottom 208 to form the base 202. The uppermost edges of the sidewalls 210, 212 and the end walls 214, 216 define a perimeter of the base 202 by which a lower flange 218 is integrally connected thereto. The lower flange 218 generally projects in an outwardly or an approximately perpendicular fashion relative to the perimeter.

The lid 204, integrally connected to an upper flange 222, may include an outer raised portion 220, having an integrally connected inner recessed portion 217 (See FIG. 15). The upper flange 222 generally projects in an outwardly or an approximately perpendicular fashion relative to the perimeter of the lid 204. A front portion 221 of the upper flange 222 (opposite the hinge 206) may include a connecting member 238 located between a pair of extending latching portions 228*a* and 230*a* of locking mechanisms 228 and 230 (described below in further detail) and extending upwardly from the upper flange 222. The connecting member 238 may have an upper connecting surface edge 238*a* and an opposing lower connecting surface edge 238*b* integrally connected by a pair of side connecting surface edges 238*c*. According to one example, the upper connecting surface edge 238*a* may have a length shorter than the length of the lower connecting surface edge 238*b* such that the pair of side connecting surface edges 238*c* extend downwardly at an angle from the upper connecting surface edge 238*a* to the lower connecting surface edge 238*b*.

A peelable flap portion 213 is formed within the inner recessed portion 217 and the boundaries of which are comprised of a back edge 215*a*, a pair of side edges 215*b* connected to the back edge 215*a* and a pair of front edges 215*c* connected to proximal ends of the pair of side edges 215*b* and extending inwardly to a tab 236. Although the pair of front edges 215*c* are shown angled inwardly, this is by way of example only and the pair of front edges 215*c* may extend perpendicularly from the pair of side edges 215*b* to the 236 or at any other angle. The back edge 215*a* of the peelable flap portion 213 may be integrally connected to the inner recessed portion 217 while the pair of side edges 215*b* and the pair of front edges 215*c* may be separable or detachable from the inner recessed portion 217 by perforations 215 or scoring. The peelable flap portion 213 may be peeled upwardly allowing access to the interior of the container. The peelable flap portion 213 is flexible and remains secured to the lid 204 allowing the peelable flap portion 213 to be lowered back into the original position closing or resealing the container 200. The peelable flap portion 213 may further include one or more protrusions 207 configured for allowing the consumer to easily grip the peelable flap portion 213 and pull it back. Although four protrusions 207 of varying lengths are shown, this is by way of example only and the peelable flap portion 213 may have less than four protrusions 207 or more than four protrusions. Alternatively, the peelable flap portion 213 may include no protrusions. Although the four protrusions 207 are shown of varying length which increases, this is by way of example only and the protrusions may be of the same length.

The lid 204 may further comprise the tab 236 connected to or formed into the peelable flap portion 213 between the pair of front edges 215*c* at a distal end of the tab 236 and detachably connected to the upper connecting surface edge 238*a* of the connecting member 238. As can be seen in FIG. 15 for example, the tab 236 may comprise a flexible elongated component or material 236*a* having an elongated protrusion 236*b* extending horizontally and parallel to the upper flange 222. Tab openings or vents 240 may be located on the sides of the tab 236. To obtain the contents of the container 200, a user may push inwardly on the tab 236 breaking or detaching the flexible elongated component or material 236*a* of the tab 236 from the connecting member 238 as shown in FIG. 10 with reference to container 100. Once the flexible elongated component or material 236*a* of the tab 236 is broken from the connecting member 238, the user may then pull upwardly on the peelable flap portion 213 breaking the perforations 215 connecting the peelable flap portion 213 from the inner recessed portion 217 providing access to the interior of the container 200. Similarly to the container 100 in FIGS. 9 and 10, the flexible elongated component or material 236*a* of the tab 236 may be separated or detached from the connecting member 238. As the tab 236 and the peelable flap portion 213 operate and function in the same manner as in container 100, the peelable flap portion 213 may be partially pulled upward with the perforations on the pair of front edges 215*c* broken (See FIG. 11 with reference to the peelable flap portion 113) or may be pulled all the way back breaking all the perforations 215 allowing access to the interior of the container (See FIG. 12).

According to one example, the outer raised portion 220 may have a substantially rectangular or square shape. However, in alternative embodiments, the outer raised portion 220 may be in the form of a different shape including but not limited to an oval, triangle, square, circular or other polygons.

According to one example, top openings or vents 233 may be spaced apart along the sides and back end of the outer raised portion 220 to allow air to circulate through the container 200.

According to one example, base openings or vents 235 may be spaced apart along the sides, front end and back end of the base 202 of the container 200 to allow air to circulate through the container 200.

The container 200 may also include a pair of locking mechanisms 228 and 230 to secure the lid 204 to the base 202 and prevent consumers from prematurely or easily opening the container 200 prior to sale, as well as preventing the lid 204 from separating from the base 202 during transportation and spilling and/or damaging its contents. The pair of locking mechanisms 228 and 230 may include extending latching portions 228*a* and 230*a* (See FIG. 16) which may be received by latch receiving openings 228*b* and 230*b* of a locking mechanism (See FIG. 17). The latch receiving openings 228*b* and 230*b* may be openings in the flange 218 of the base 202 of the container. According to one example, the latch receiving openings 228*b* and 230*b* may be in the form of an elongated "U" shape such that a horizontal elongated opening may be located between a pair of vertical elongated openings where the horizontal elongated openings have a length that is longer the length of each of the vertical elongated openings. This shape is by way of example only and other configurations of openings may be utilized. The extending latching portions 228*a* and 230*a* may be received into or pushed through the latch receiving openings 228*b* and 230*b* securing the lid 204 to the base 202. FIG. 18 illustrates extending latching portions 228*a* and

230*a* received within the latch receiving openings 228*b* and 230*b* securing the lid 204 to the base 202 of the container 200.

According to one example, the extending latching portions 228*a* and 230*a* include vertical concave grooves located on each side of the extending latching portions 228*a* and 230*a*, for example concave groove 230$a_1$ on extending latching portion 230*a* as shown in FIG. 16. Although one concave groove is shown 230$a_1$, an extending latching portion has concave grooves located on opposing sides of the extending latching portion 228*a*. The concave grooves 230$a_1$ allow the extending latching portions to flex inwards from an initial position for insertion into the pair of latch receiving openings 228*b* and 230*b*. When the pair of extending latching portions 228*a* and 230*a* are inserted into the pair of latch receiving openings 228*b* and 230*b*, the pair of extending latching portions 228*a* and 230*a* expand back to their initial position preventing the pair of extending latching portions 228*a* and 230*a* from easily being disengaged or pulled from the pair of latch receiving openings 228*b* and 230*b* creating a tighter fit and preventing the lid 204 from being easily disengaged from the base 202.

An extending latching portion 230*a* may have a lower portion 230$a_2$ and an upper portion 230$_{a3}$, the lower portion 230$a_2$ integrally formed into the upper flange 222. The lower portion 230$a_2$ may be connected to the upper portion by a ring 230$_4$ or other distinguishing demarcation. The lower portion 230$a_2$ may have a generally rectangular shape with sloping or end sides 230$_5$ extending outwardly from the connection of the upper and lower portions to the flange 222.

An edge 230$_6$ on the upper portion 230$_3$ of the extending latching portion 230*a* may be used to guide itself into the latch receiving opening 230*b* if the lid and the base are not properly aligned when the lid and the base are pinched, pushed or rolled together to lock or engage the lid to the base preventing the requirement of having direct alignment.

When the extending latching portions 228*a* and 230*a* are engaged with the latch receiving openings 228*b* and 230*b*, the container 200 cannot be open except by pushing inward on the tab 236 and then pulling the peelable flap portion 213 upward. As shown, the extending latching portions may have a spade configuration. Although two locking mechanisms 228 and 230 are shown, the container 200 may have only one locking mechanism or may have more than two locking mechanisms.

According to one aspect, the outer raised portion 220 may have first and second notches 224 and 226 in the same location as the extending latching portions 228*a* and 230*a* of locking mechanisms 228 and 230, respectively, allowing for a user to place a thumb or other finger to easily open the container.

According to one aspect, a back upper portion of the base 202 near the hinge 206 may include one or more openings or receiving members 242 configured to receive extending latching portions 244 located at a back portion of the lid 204 near the hinge 206. When the lid 204 is secured to the base 202, the extending latching portions 244 at located at the back portion of the lid 204 near the hinge 206 engage with the openings or receiving members 242 near the hinge 206 providing additional closure points between the base 204 and the lid 202 and additional visible evidence to the consumer that the container 200 has been properly sealed and not tampered with.

One or more of the components and functions illustrated in the previous figures may be rearranged and/or combined into a single component or embodied in several components without departing from the invention. Additional elements or components may also be added without departing from the invention.

While certain exemplary embodiments have been described and shown in the accompanying drawings, it is to be understood that such embodiments are merely illustrative of and not restrictive on the broad invention, and that this invention is not be limited to the specific constructions and arrangements shown and described, since various other modifications may occur to those ordinarily skilled in the art.

The invention claimed is:

1. A container, comprising:

a base having a bottom, a pair of sidewalls, and a pair of end walls, the bottom, the pair of sidewalls and the pair of end walls being integrally connected wherein an edge of the pair of sidewalls and the at least one end wall extend outwardly to form a lower flange, the lower flange comprising at least two latch receiving openings; and a lid hingedly connected to the base, the lid comprising:

an outer raised portion having an integrally connected inner recessed portion formed therein, wherein the inner recessed portion includes a peelable flap portion partially detachable from the inner recessed portion for lifting the peelable flap upwardly from the inner recessed portion;

an upper flange extending perpendicularly outward from a perimeter of the lid and having a connecting member located between at least at least two extending latching portions extending outwardly from the upper flange, the at least two extending latching portions adapted for being received in the at least two latch receiving openings; and a tab connected to the peelable flap portion on a first end and detachably connected to the connecting member on a second end, where the tab is configured for pushing inward detaching the second end from the connecting member allowing the peelable flap portion to be lifted upwardly away from the inner recessed portion.

2. The container of claim 1, wherein the inner recessed portion comprises:

a back edge;

a pair of side edges having proximal ends and distal ends, the distal ends integrally connected to the back edge; and a pair of front edges integrally connected to the proximal ends of the pair of side edges and extending inwardly to the tab.

3. The container of claim 2, wherein the peelable flap portion is integrally connected to the back edge of the inner recessed portion and detachably connected to the pair of side edges and the pair of front edges of the peelable flap portion.

4. The container of claim 3, wherein the peelable flap portion is detachably connected to the pair of side edges and the pair of front edges of the inner recessed portion by perforations.

5. The container of claim 1, wherein the tab is located between a pair of tab vents.

6. The container of claim 1, wherein the tab is comprised of a flexible elongated material.

7. The container of claim 1, wherein the tab includes a horizontally elongated protrusion.

8. The container of 1, wherein the connecting member comprises;

an upper surface edge;

a lower connected surface edge opposing the upper surface edge;

a pair of side surface edges integrally connecting the upper surface edge and the lower surface edge.

9. The container of claim 8, wherein a length of the upper surface is shorter than a length of the lower surface.

10. The container of 1, wherein the peelable flap portion fits is received within the inner recessed portion once peeled back allowing reclosure.

11. The container of 1, wherein the peelable flap portion includes one or more protrusions before the tab.

12. The container of 11, wherein each of the one or more protrusions is of varying length.

13. The container of claim 1, wherein the base includes a plurality of base vents for allowing air to circulate within the container.

14. The container of claim 1, wherein the base further comprises a base back upper portion of having one or more back upper portion openings; wherein the lid further comprises a lid back portion having lid extending latching portions; and wherein the lid extending latching portions are received within the one or more back upper portion openings when the lid is secured to the base.

15. A container, comprising:

a base having a bottom, a pair of sidewalls, and a pair of end walls, the bottom, the pair of sidewalls and the pair of end walls being integrally connected wherein an edge of the pair of sidewalls and the at least one end wall extend outwardly to form a lower flange, the lower flange comprising at least two latch receiving openings; and a lid hingedly connected to the base, the lid comprising:

an outer raised portion having an integrally connected inner recessed portion formed therein, wherein the inner recessed portion includes a peelable flap portion partially detachable from the inner recessed portion for lifting the peelable flap upwardly from the inner recessed portion, the inner recessed portion comprising:

a back edge;

a pair of side edges having proximal ends and distal ends, the distal ends integrally connected to the back edge;

a pair of front edges integrally connected to the proximal ends of the pair of side edges and extending inwardly to the tab; and wherein the peelable flap portion is integrally connected to the back edge of the inner recessed portion and detachably connected to the pair of side edges and the pair of front edges of the peelable flap portion by perforations; and an upper flange extending perpendicularly outward from a perimeter of the lid and having a connecting member located between at least at least two extending latching portions extending outwardly from the upper flange, the at least two extending latching portions adapted for being received in the at least two latch receiving openings; and a tab connected to the peelable flap portion on a first end and detachably connected to the connecting member on a second end, where the tab is configured for pushing inward detaching the second end from the connecting member allowing the peelable flap portion to be lifted upwardly away from the inner recessed portion.

16. The container of claim 15, wherein the tab is located between a pair of tab vents and comprised of a flexible elongated material.

17. The container of claim 15, wherein the tab includes a horizontally elongated protrusion.

18. The container of 15, wherein the connecting member comprises;

an upper surface edge;

a lower connected surface edge opposing the upper surface edge;

a pair of side surface edges integrally connecting the upper surface edge and the lower surface edge.

19. The container of claim 15, wherein the base further comprises a base back upper portion of having one or more back upper portion openings; wherein the lid further comprises a lid back portion having lid extending latching portions; and wherein the lid extending latching portions are received within the one or more back upper portion openings when the lid is secured to the base.

20. The container of claim 15, wherein the base includes a plurality of base vents for allowing air to circulate within the container.

* * * * *